United States Patent [19]

Renger

[11] 3,955,310

[45] May 11, 1976

[54] AUTOMATIC CONTROL DEVICE FOR TETHERED MODEL AIRPLANE

[75] Inventor: Larry H. Renger, Costa Mesa, Calif.

[73] Assignee: L. M. Cox Manufacturing Co., Inc., Santa Ana, Calif.

[22] Filed: Dec. 23, 1974

[21] Appl. No.: 535,979

[52] U.S. Cl. ..... 46/77; 244/76 R; 244/80

[51] Int. Cl.[2] ..... B64C 17/04

[58] Field of Search ..... 244/80, 87, 93, 76 R, 244/76 B, 76 C, 75 R; 46/78, 77, 76 R, 74 R; 272/31 A

[56] References Cited

UNITED STATES PATENTS

| | | | |
|---|---|---|---|
| 2,454,598 | 11/1948 | Doyle | 244/80 UX |
| 2,523,902 | 9/1950 | Effinger, Jr. | 46/77 |
| 3,032,296 | 5/1962 | Streubel | 244/80 |

*Primary Examiner*—Trygve M. Blix
*Assistant Examiner*—Galen L. Barefoot

[57] ABSTRACT

A model airplane control device for automatically adjusting to wind conditions to maintain a generally level flight. The control device is responsive to changes in the inertial forces of the model airplane while in flight, eliminating the need for control cables to positively control the elevation of the model airplane. The device is designed to allow a child to hold a tethered model airplane in flight without having to control the vertical movement of the aircraft to make adjustments for variable wind conditions. The control device is connected to the elevator of the model airplane, so that movement of a balance arm will result in a responsive movement of the elevator. Included in the control assembly is a switching device which allows the operator to utilize a single airplane and alternately switch between automatic control of the airplane responsive to changes in inertial forces or acceleration in the airplane and the positive hand control responsive to the use of control lines.

3 Claims, 7 Drawing Figures

FIG. 1.
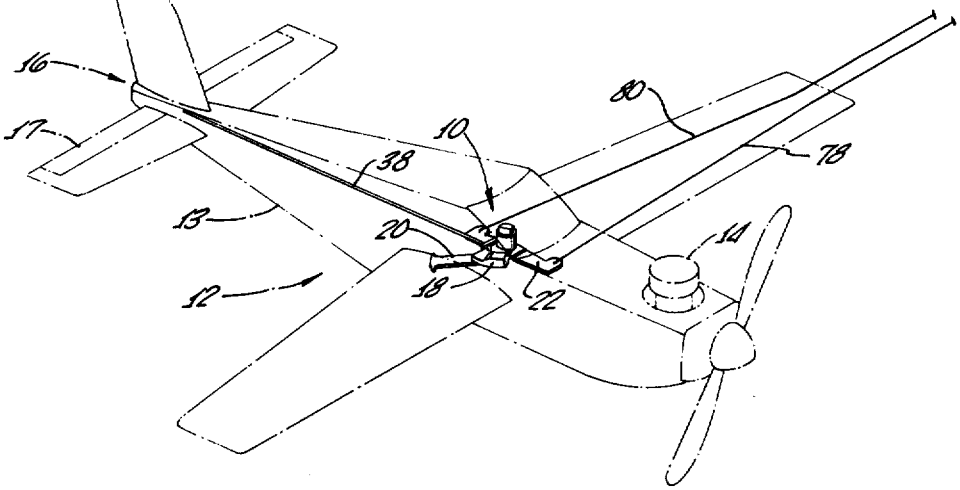
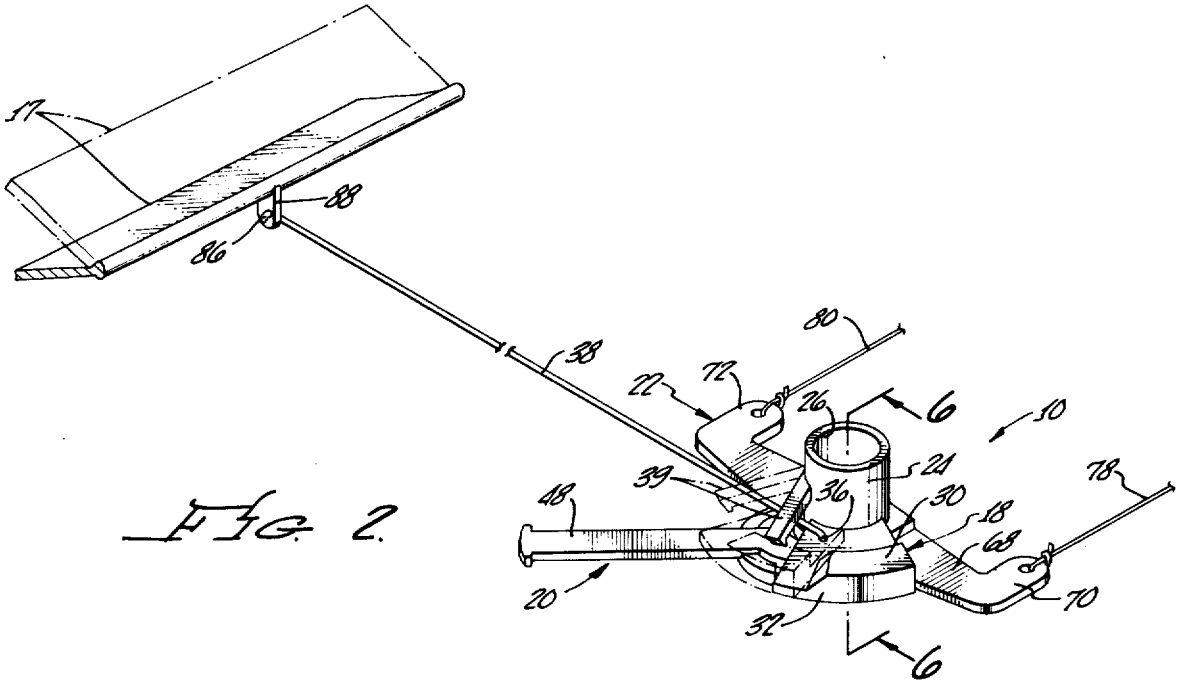
FIG. 2.

FIG. 6.
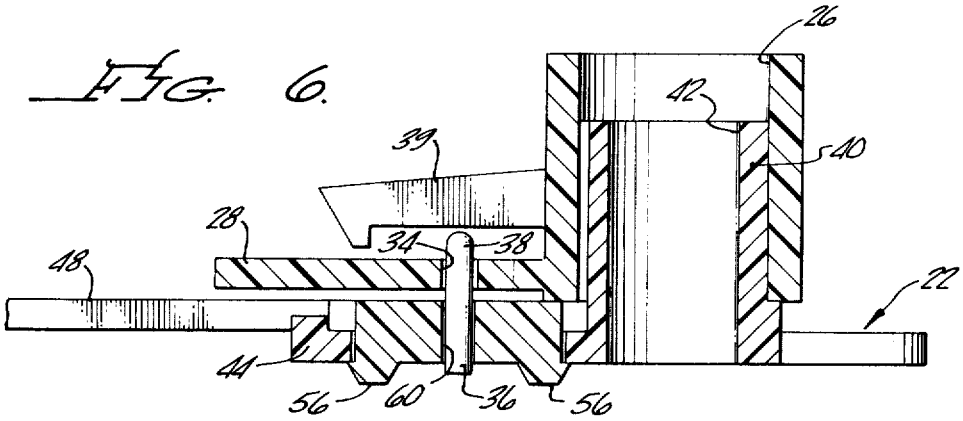
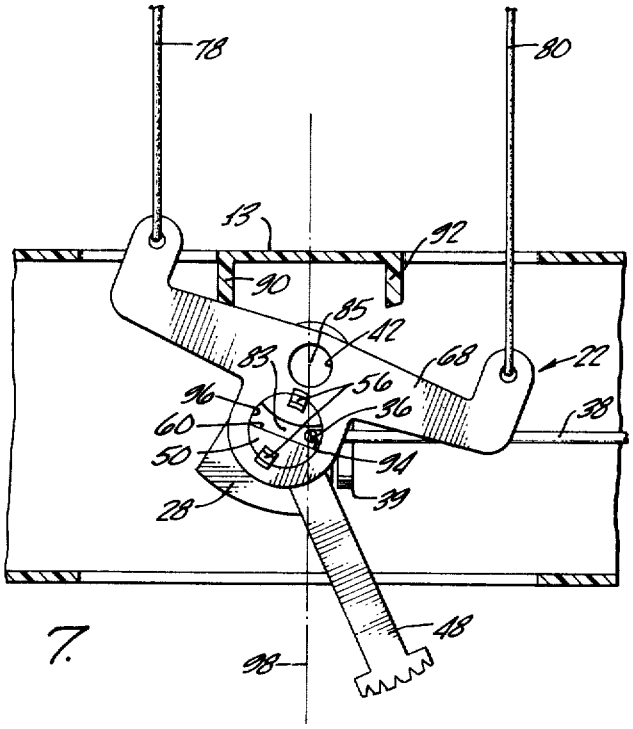
FIG. 7.

AUTOMATIC CONTROL DEVICE FOR TETHERED MODEL AIRPLANE

BACKGROUND OF THE INVENTION

This invention relates to the field of model airplanes and more specifically relates to the field of powered tethered model airplanes. When using a tethered model airplane, one must provide some control device within the airplane in order to compensate for possible changes in the altitude of the airplane in order to render a generally level flight path as it proceeds in circular path around the operator. Typically the control mechanism utilizes a movable bell crank arm mounted within the airplane and connected in some way to the control elevator on the airplane. The bell crank is connected to a pair of control cables which lead to the operator of the airplane. Depending upon the relative movement of the pair of control lines, the operator may pivot the bell crank causing a responsive movement in the elevator to accomplish a climbing or diving maneuver of the airplane to compensate for any possible changes in the altitude of the airplane.

It is somewhat difficult for a beginner or a young child, operating a model airplane with this dual line control mechanism, to properly control the aircraft to maintain the desired flight path. In many instances the child or inexperienced operator will over-compensate for wind conditions or undesirable movement of the airplane, resulting in a loss of control and a possible damaging crash. Further the operator must turn in a circle with the airplane to avoid twisting the two control lines, thereby sometimes causing dizziness. Consequently, it is desirable to have a model airplane which can be operated without the need to constantly control its flight movements by the operator as he holds the tether line when the plane is moving in a circular path.

SUMMARY OF THE INVENTION

The automatic control device for the tethered model airplane comprises a pivotal balance arm having a weighted free end. The balance arm is connected by a rigid member to the movable elevator of the airplane and the position of the elevator determines the angle of climb or descent of the airplane. Tether lines are connected to the aircraft and, as the aircraft proceeds around the operator in a circular movement, the centrifugal force which is generated on the airplane swings the balance arm with its weighted free end outward in a line generally parallel with the tether lines of the aircraft. As the airplane encounters various wind conditions, it may slow down or speed up causing the inertia of the weight on the free end of the balance arm to move the balance arm forward or backward relative to the airplane body, resulting in a responsive movement of the elevator which will compensate for any climb or descent of the aircraft caused by the impact of the wind conditions and return the airplane to level flight. Therefore, the free swinging balance arm provides an automatic control within the airplane to adjust for the wind conditions in order to provide a generally level flight of the airplane as it proceeds around in its circular path determined by the tether line held by the operator.

A young child utilizing the model airplane for the first time can become acquainted with the general feel of directing a model airplane in a circle by himself without having to also be acutely aware of control problems in maintaining a generally level flight to avoid any possible damage from a crash landing and without having to rotate with the model airplane. Once the child becomes more experienced and has the feel of moving a powered model airplane around in a circle, it is desirable that he develop his ability to positively control the upward or downward movement of the airplane. The device of this invention includes a switching mechanism which allows the airplane to be switched from the automatic control mode of operation to a positive hand control mode of operation wherein the operator through the use of the pair of control or tether lines can directly move the elevator as he wants to produce a desired descent or ascent of the airplane.

BRIEF DESCRIPTION OF THE DRAWINGS

FIG. 1 is a perspective view of the control device mounted within a model airplane;

FIG. 2 is an enlarged perspective view of the control device connected to the airplane elevator;

FIG. 6 is a sectional view taken along the lines 6—6 in FIG. 2; and

FIG. 7 is a plan view of the stop guards mounted within the airplane to limit the throw of the bell crank.

DETAILED DESCRIPTION OF THE INVENTION

Figure 3:
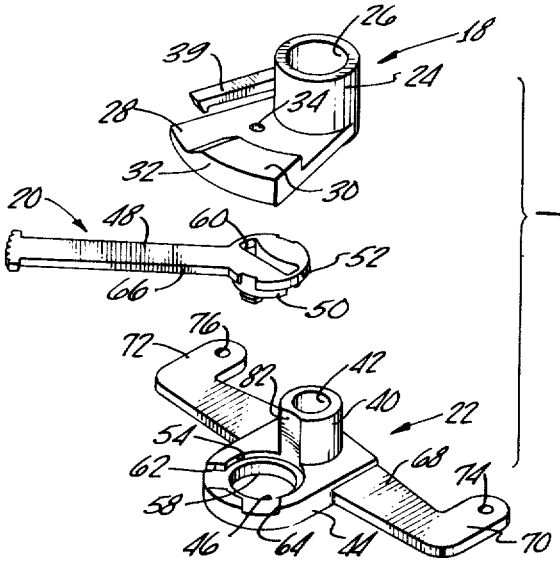
FIG. 3 is an exploded view of the control device.

Referring to FIG. 1, the control device 10 is shown mounted within the model airplane 12 having a fuselage 13, a power source 14, a wing 15, and a tail assembly 16 with a control elevator 17. The control device or mechanism 10 is shown in more detail in FIGS. 2 and 3 and has three primary components, including a balance arm 18, a switching mechanism 20, and a bell crank 22. The balance arm 18 has a cylindrical portion 24 with a pivoting opening 26. Extending outward from the cylindrical portion 24 is a generally triangularly shaped arm 28 having an enlarged weighted portion 30 on its free end 32. Located within the arm portion 28 is a connecting hole 34 which is designed to receive one end 36 of the connecting rod 38. Also extending out from the cylindrical portion 24 adjacent the arm portion 28 is a holding arm 39 which holds the connecting rod 38 anchored in the hole 34.

Positioned on the bell crank 22 is a pivotal shaft 40 having a receiving aperture 42. The pivotal shaft 40 is designed to fit within the pivoting aperture 26 of the balance arm 18. Extending out from the bell crank 22 is the seating portion 44 having a switching aperture 46. The switching unit 20 with its switching arm 48 and switching plate 50 are designed to fit onto the seating portion 44 with the switching plate 50 mating within the switching aperture 46. The ledge 52 of the switching plate 50 fits within the aperture ledge 54 of the seating portion 44 in order to prevent the switching plate 50 from slipping completely through the seating aperture 46. Located on the switching plate 50 are snap extensions 56 which snap under the edge 58 of the seating aperture 46 to hold the switching plate 50 within the seating portion 44. Located within the switching plate 50 is a shifting slot 60 designed to receive the forward end 36 of the connecting rod 38.

Cut within the seating portion 44 are a first channel 62 and a second channel 64 which are designed to receive the portion 66 of the switching arm 48 adjacent the intersection of the switching arm 48 and the switching plate 50. The switching arm 48 is situated within the first channel 62 during one mode of operation of the invention and during a second mode of operation the switching arm 48 is positioned within the second channel 64. The bell crank 22 consists of a main arm 68 with a first projection 70 at one end and a second projection 72 at the other end. Located within the projections 70 and 72 are the respective apertures 74 and 76 designed to receive the respective control cables 78 and 80. Located on the surface of the pivot shaft 40 is an indented rounded portion 82 to allow molding the inner edge of the seating aperture 46 and also to allow smooth rotation of the switching plate 50 when the switching arm 48 is moved between the first channel 62 and the second channel 64. With respect to FIG. 7, it is important that the center-to-center distance between the center 83 of the switching plate 50 and the center 85 of the receiving aperture 42 be as short as possible, so that the slot 60 is long enough in the automatic control mode to allow the balance arm 18 to pivot sufficiently to maintain level flight.

Referring to FIGS. 1 and 3, the receiving aperture 42 of the pivoting shaft 40 is pivotally mounted on a mounting shaft (not shown) within the airplane 12, so that the axis of rotation of both the balance arm 18 and the bell crank 22 is approximately perpendicular to the longitudinal axis of the fuselage 13 of the airplane 12. As shown in FIG. 2, the trailing end 86 of the connecting rod 38 is positioned within a bracket 88 rigidly attached to the elevator 17 of the airplane.

FIG. 6 shows the interrelation of the balance arm 18, the switching mechanism 20 and the bell crank 22. The pivotal aperture 26 of the balance arm 18 is shown pivotally mounted over the pivot shaft 40 which is connected to the bell crank 22. Extending into the aperture 34 and down through the shifting slot 60 is the forward end 36 of the connecting rod 38. The retaining arm 39 is shown maintaining the forward end 36 of the connecting rod 38 within the aperture 34 and slot 60.

Turning to the operation of this invention reference will be made first to the automatic flight control mode of operation. With respect to FIG. 4, the switching arm 48 is positioned so that the shifting slot 60 is oriented in a generally parallel relation with the arm 68 of the bell crank 22. With respect to FIG. 3 the switching arm 48 is located within the channel 62 of the seating portion 44 in order to have the shifting slot 60 parallel to the arm 68 of the bell crank 22. The forward end 36 of the connecting rod 38 is permitted to shift freely along the longitudinal axis of the shifting slot 60. Referring to FIG. 2, since the forward end 36 of the connecting rod 38 is anchored within the balance arm 18, any shifting motion of the connecting rod 38 is caused by a respective swinging or pivotal movement of the balance arm 18 around the pivot shaft 40 which is shown in FIG. 3.

As the plane is flying in a general circular path around the operator, the weighted portion of the free end 32 of the balance arm 18 is held radially outward by centrifugal force in a direction generally perpendicular to the tangent of the circular path in the flight of the aircraft. When the balance arm 18 is in the position generally perpendicular to the tangent of the circular path of the aircraft, the connecting rod 38 positions the elevator 17 in a generally horizontal position, so that level flight is maintained as the aircraft proceeds around in a circular path. When the airplane encounters an oncoming gust of wind, it will tend to soar due to increased wind speed while undergoing a deceleration or negative acceleration of the airplane ground speed. The inertia of the weighted end 30 of the balance arm 18 causes the balance arm to swing forward to the position shown in solid lines on FIG. 2 relative to the airplane as a result of the airplane's deceleration. Consequently, the connecting rod is shifted forward causing the elevator 17 to move downward which will cause the plane to nose downward and again assume a level flight. The principle of operation of the balance arm is much the same as experienced when a passenger airplane suddenly slows down and the passengers are thrown forward, since they are still travelling at the original speed of the airplane. The situation is similar, but in the reverse sequence if the aircraft should encounter wind which would cause it to descend, increasing its velocity. In such a situation, the airplane would move relative to the balance arm 18 because the airplane would be accelerating, and the balance arm 18 would assume the position as shown in phantom on FIG. 2, causing the connecting rod to shift toward the rear of the aircraft moving the elevator 17 upward. This will cause the plane to move up out of its downward movement and restore level flight in a circular path.

In the automatic mode of operation the operator may stand in a fixed position and let the airplane rotate around above his head, since any twisting of the control cables will not affect the automatic control of the airplane. Being able to operate the airplane in this manner, the operator will avoid any dizziness caused by having to constantly turn with the circular flight path of the airplane.

Figure 5:
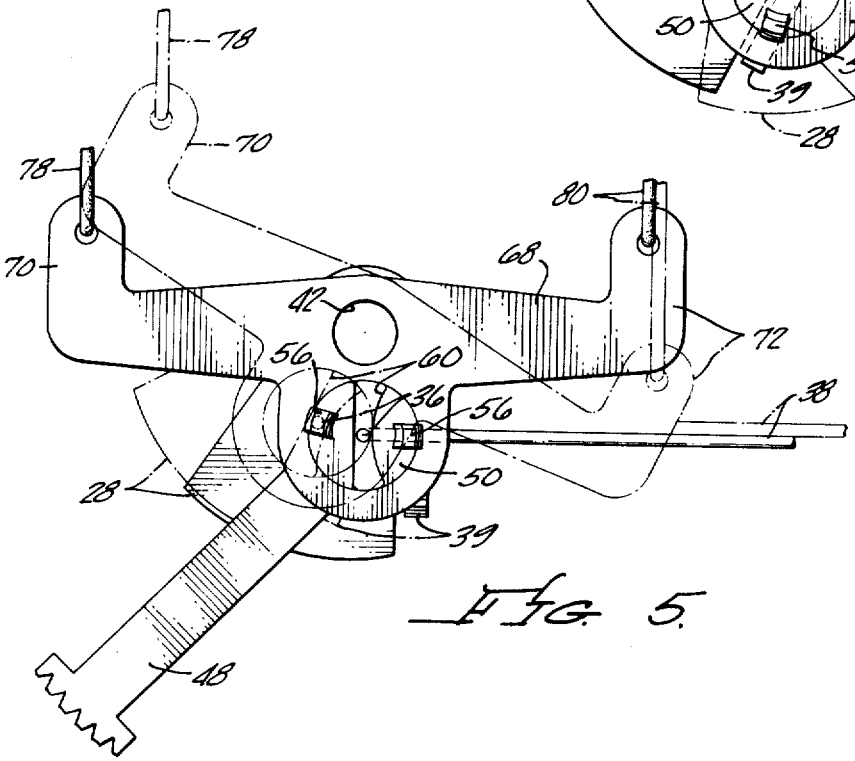
FIG. 5 is a bottom plan view of the switching component of the control device in a second mode of operation.

The above operational discussion concerns the automatic control mode of operation. The discussion now will be directed to the switching mechanism 20 that allows for the control assembly to be converted to a positive hand control mode of operation utilizing the control lines 78 and 80 connected to the bell crank 22. In order to switch to the positive hand control mode of operation, the switching arm 48 is moved to the position on the seating plate 44 as shown in FIG. 5. As a result, the shifting slot 60 is rotated approximately 90° to a general perpendicular orientation longitudinally with respect to the arm 68 of the bell crank 22. Since the connecting rod 38 is designed to move generally in a longitudinal direction, the forward end 36 of the connecting rod will remain essentially fixed within the slot 60. Consequently, any movement of the bell crank 22 with a corresponding movement of the switching plate 50 will cause the connecting rod 38 to shift and move the elevator 17. Because the balance arm 18 is also connected to the forward end 36 of the connecting rod 38, any movement of the connecting rod 38 will cause the balance arm 18 to move.

When an operator is flying the airplane in a circular route and he desires to cause the plane to soar or dive, he manipulates the bell crank 22 by the use of the control lines 78 and 80. For example, if the operator desires to descend the aircraft or put it into a dive, he pulls on the control cable 78 to place the bell crank in the general orientation as shown in phantom in FIG. 5 which will cause the seating portion of the bell crank 44 to rotate clockwise as viewed in FIG. 5, shifting the forward end 36 of the connecting rod to the left. This will cause the elevator to move to a down position and will nose the aircraft downward. When it is desired to have the aircraft climb, the bell crank is rotated in the opposite direction with a pulling force on the control cable 80, so that the seating portion 44 of the bell crank will rotate counterclockwise with respect to FIG. 5, shifting the connecting rod 38 to the right in FIG. 5 to place the elevator in the up position.

With respect to the automatic mode of operation, stop guards 90 and 92 as shown in FIG. 7 are mounted along the fuselage 13 in order to prevent excessive rotation of the bell crank 22 in either the clockwise or counter-clockwise direction. It is important that the one end 94 of the slot not go beyond the line 98 when rotated clockwise and, similarly, the other end 96 should not go beyond the line 98 when rotated counter-clockwise. If either end 94 or 96 of the slot 60 is rotated respectively clockwise or counterclockwise and extend beyond the line 98, which is perpendicular to the fuselage 13 and through the center 85 of the receiving aperture 42, the connecting rod 38 will not have enough play in the slot 60 to adequately control the elevator of the airplane to maintain level flight. The interrelation of the stop guards 90 and 92, the distance between the receiving aperture 42 and the switching plate 50, and the length of the slot 60 are critical in providing adequate control of the airplane when in the automatic control mode. Therefore, when the plane is flying and the balance arm 18 is held out in its neutral position by centrifugal force, enough play or movement of the forward end 36 of the connecting rod 38 will remain in the slot 60 to allow the balance arm 18 to move and adjust the elevator. Consequently, regardless of which way the bell crank 22 is rotated or held by the control lines 78 and 80 during the automatic control mode of operation, the balance arm is free to move adequately to control the elevator to maintain level flight.

Figure 4:
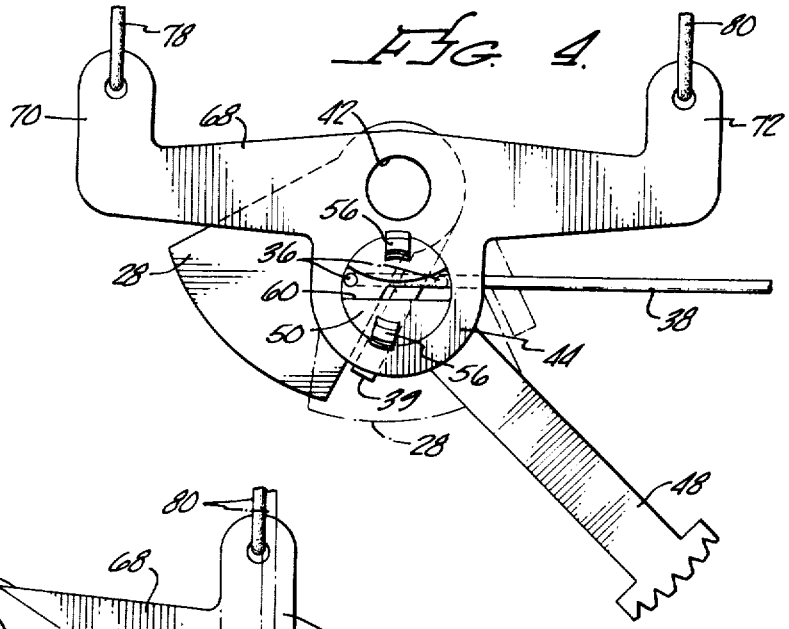
FIG. 4 is a botton plan view of the switching component of the device in a first mode of operation.

When an inexperienced operator or child first flies the airplane having the control device invention, the switching mechanism is switched to the automatic control mode wherein the switching arm 48 is positioned as shown in FIGS. 2 and 4. As the plane is flown by the operator holding the tether lines 78 and 80, the plane will fly in a circular route with the balance arm 18 automatically controlling the elevator 17 to compensate for environmental wind conditions, so that the plane will maintain a generally level circular flight path. This will allow the inexperienced beginner to obtain a knowledge and feel for the operation and movement of a model airplane through the air without having to constantly be concerned with controlling the elevation of the aircraft to avoid undesirable climbs or dives in the aircraft's movement.

Once the individual has gained the necessary experience and knowledge of moving an aircraft in a circular route, the switching arm 48 of the switching mechanism 20 can be moved to the orientation as shown in FIG. 5, so that pivotal movement of the bell crank 22 will result in a responsive shifting movement on the connecting rod 38 and elevator 17. The individual, when flying the plane having the control cables 78 and 80 can put the plane through various maneuvers such as a climb or dive, depending upon his relative movement of the control cables 78 and 80. The control device disclosed herein when mounted within a model airplane provides the individual with a single airplane which can be used in two phases of operation in accordance with the experience of the operator.

What is claimed is:

1. A control mechanism for a tethered model airplane, said mechanism comprising:

means movably mounted on said airplane for controlling the vertical movement of said airplane;

means responsive to acceleration of said airplane for moving said controlling means;

means for connecting said controlling means and said moving means;

a bell crank movably mounted on said airplane adjacent said moving means and responsive to a control line;

a seating portion attached to said bell crank and having an aperture;

a switching plate rotatably mounted in said aperture, said switching plate having a slot for receipt of one end of said connecting means; and a switching arm to move said switching plate between two positions, said moving means responsive to said acceleration of said airplane when said switching arm is in one of said two positions, said moving means responsive to said bell crank and said control line when said switching arm is in the other of said two positions.

2. A control mechanism for a tethered model airplane, said mechanism comprising:

means movably mounted on said airplane for controlling the vertical movement of said airplane;

means responsive to acceleration of said airplane for moving said controlling means; and means for connecting said controlling means and said moving means, said moving means having a balance arm pivotally mounted in said airplane, said balance arm having a free end and a pivot end, said free end having a weighted portion which extends outward radially from said pivot end by centrifugal force in a direction generally radial to the circular path of said airplane when said airplane is in level flight, said free end of said balance arm shifting from said direction when the ground speed of said airplane changes.

3. A control device having two modes of operation for a tethered model airplane, said device comprising:

an elevator movably mounted on the tail assembly of said airplane;

a balance arm having one end pivotally mounted on the fuselage of said airplane and a free weighted end;

a connecting rod having one end attached to said elevator and the other end attached to said balance arm, said elevator moving in response to movement of said balance arm;

a bell crank arm pivotally mounted on said fuselage adjacent said one end of said balance arm;

a seating member connected to said bell crank; and a switch rotatably mounted within said seating member, said switch having a slot, said other end of said connecting rod projecting into said slot, said switch moving said slot between a first and second position, said slot generally parallel to the longitudinal axis of said bell crank arm when in said first position, said slot generally perpendicular to said longitudinal axis of said bell crank arm when in said second position, said balance arm movable in response to acceleration of said airplane when said slot is in said first position, said balance arm movable in response to movement of said bell crank arm when said slot is in said second position.

* * * * *